United States Patent [19]

Kittredge

[11] 4,114,533

[45] Sep. 19, 1978

[54] AUTOMATIC POSTAGE METER DATE SETTER

[75] Inventor: Lloyd G. Kittredge, Trumbull, Conn.

[73] Assignee: Pitney-Bowes, Inc., Stamford, Conn.

[21] Appl. No.: 786,602

[22] Filed: Apr. 11, 1977

[51] Int. Cl.[2] ..... B41J 1/54

[52] U.S. Cl. ..... 101/99

[58] Field of Search ..... 101/95, 110, 99, 101, 101/100, 93.18, 93.21, 96, 97; 235/60 P

[56] References Cited

U.S. PATENT DOCUMENTS

| | | | |
|---|---|---|---|
| 2,973,708 | 3/1961 | Becker | 101/95 |
| 3,690,250 | 9/1972 | Bremner et al. | 101/95 |
| 3,965,815 | 6/1976 | Lupkas | 101/110 |

*Primary Examiner*—J. Reed Fisher

*Attorney, Agent, or Firm*—Peter Vrahotes; William D. Soltow, Jr.; Albert W. Scribner

[57] ABSTRACT

An automatic date setting apparatus for a postage meter is disclosed which may be attached to the housing of a postage meter. The apparatus includes solenoids that drive linkage segments which are engageable with the gear train of the meter date indicator. Each solenoid is in electrical connection with a timing device to be enabled periodically thereby.

6 Claims, 4 Drawing Figures

AUTOMATIC POSTAGE METER DATE SETTER

BACKGROUND OF THE INVENTION

In certain instances, one of the requirements of a postage meter imprint is that the date be included as part of the meter impression to indicate when a letter or package is mailed. Some type of means is usually provided for manually setting a postage meter date printer, as is shown in U.S. Pat. Nos. 2,687,692, 2,708,403 and 2,762,298. Although only the date is usually shown, at times additional information may be desirable such as whether the letter or package was marked in the A.M. or P.M. or the exact time of day within fifteen minutes. It obviously would be desirable to provide automatic or remote means for changing the date and time indicators of a postage meter.

SUMMARY OF THE INVENTION

An apparatus for automatically setting the date printer on a postage meter is provided that utilizes solenoids that are connected to a timing mechanism. The apparatus is housed in a unit which may be attached to a postage meter. Transfer wheels are provided that engage drive gears of the postage meter date printer. Means is provided for removing the transfer wheels from engagement with the drive gears when the apparatus is inoperative and for placing the transfer wheels in engagement with the drive gears when the date is to be changed. Each transfer wheel is in engagement with a solenoid through appropriate linkage members, whereby upon actuation of its associated solenoid, the transfer wheel may be rotated while in engagement with its associated drive gear to thereby rotate the latter. After the date has been changed, the transfer wheels once more are removed from the drive gears.

DETAILED DESCRIPTION OF THE PREFERRED EMBODIMENT

Figure 1:
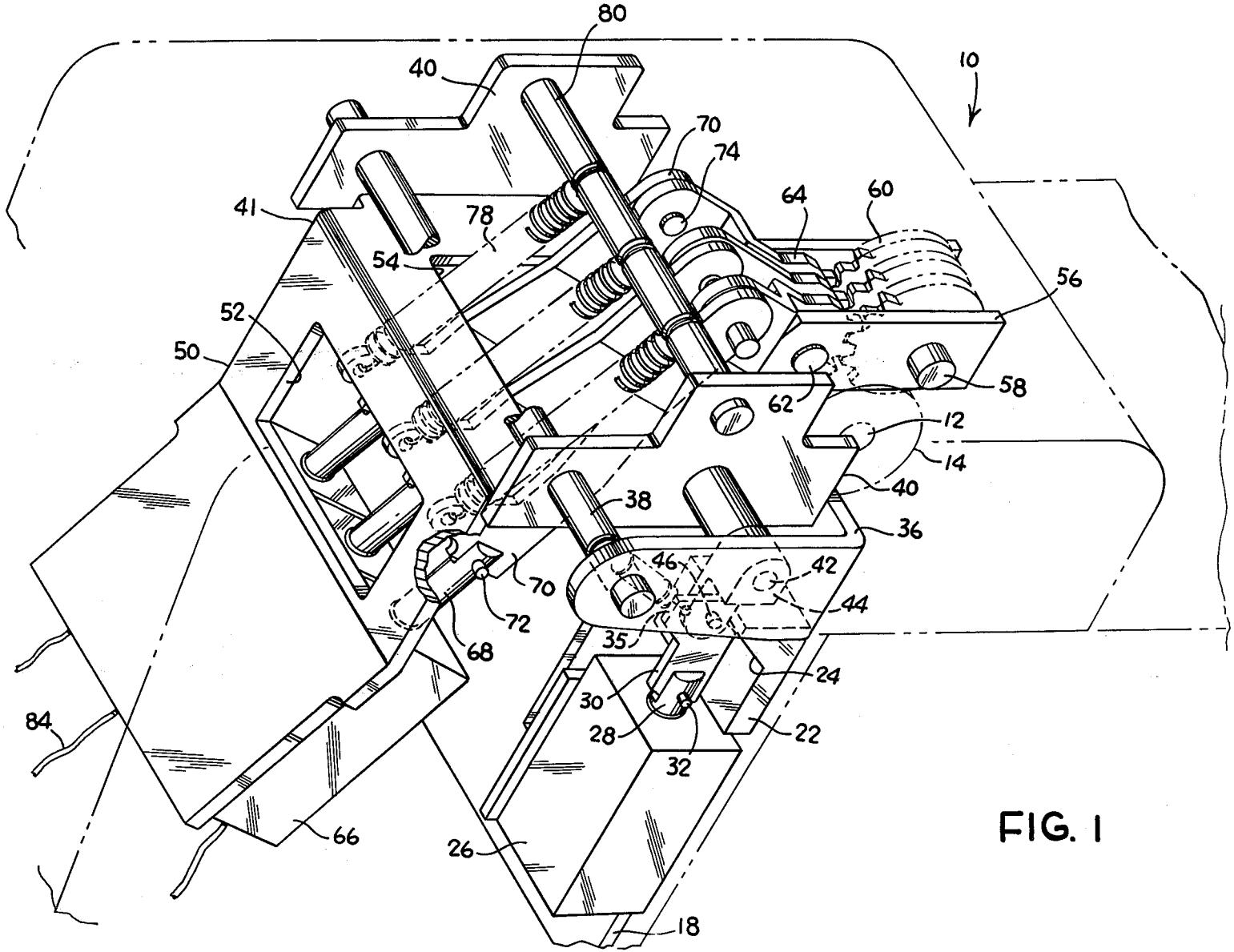
FIG. 1 shows a perspective view of an automatic date setter for a postage meter.

Referring now to the drawings, a portion of a postage meter is shown generally at 10 including a shaft 12 upon which a plurality of drive gears 14 are mounted for rotation thereabout. The drive gears 14 are part of a drive train which is operative to rotate print wheels and corresponding setting indication wheels which allow one to see the date set, of the type shown in U.S. Pat. Nos. 2,687,692 and 2,762,298. Since the gear train of this type is well known in the art, it will not be described in detail. An example of a postage meter 10 which may be utilized is the Model 5300 marketed by Pitney-Bowes, Inc., the assignee of the instant invention. The postage meter 10 is usually attached to a postage meter machine 15 that may provide drive or power to the postage meter 10. An example of a postage meter machine 15 is Model 5600 marketed by Pitney-Bowes, Inc.

An apparatus for automatically setting the date on a postage meter 10 is shown generally at 16 and includes a base or housing 18 which supports various components. The base 18 may be attached to the postage meter 10 in any convenient manner such as by bolts 20. Integral with the base is a cam member 22, the cam member having a cam surface 24. A solenoid 26 is secured to the base 20 in any convenient fashion and has extending therefrom a plunger 28. A connection link 30 is pivotally connected to the plunger 28 by a pin 32 which extends through both of these members 28, 30. The connection link 30 has a surface 34 that engages and is in geometrical conformity with the cam surface 24 and an eyelet member 35 integral therewith at the upper portion thereof. A U-shaped brace 36 is secured to or integral with the base 18 and receives therein a laterally-extending pivot shaft 38. Supported by the pivot shaft 38 are a pair of opposed side plates 40 that are an integral part of a frame member 41. A pivot 42 extends outwardly from one of the side plates 40. A linkage 44 is mounted on the pivot 42 and receives a pin 46 therein which connects the linkage 44 to the connection link 30. One end of a spring 48 is received within the eyelet member 35 and the other end of the spring is supported by the shaft 38 to bias the connection link 30 to the left as shown in FIGS. 2 and 3.

Figure 2:
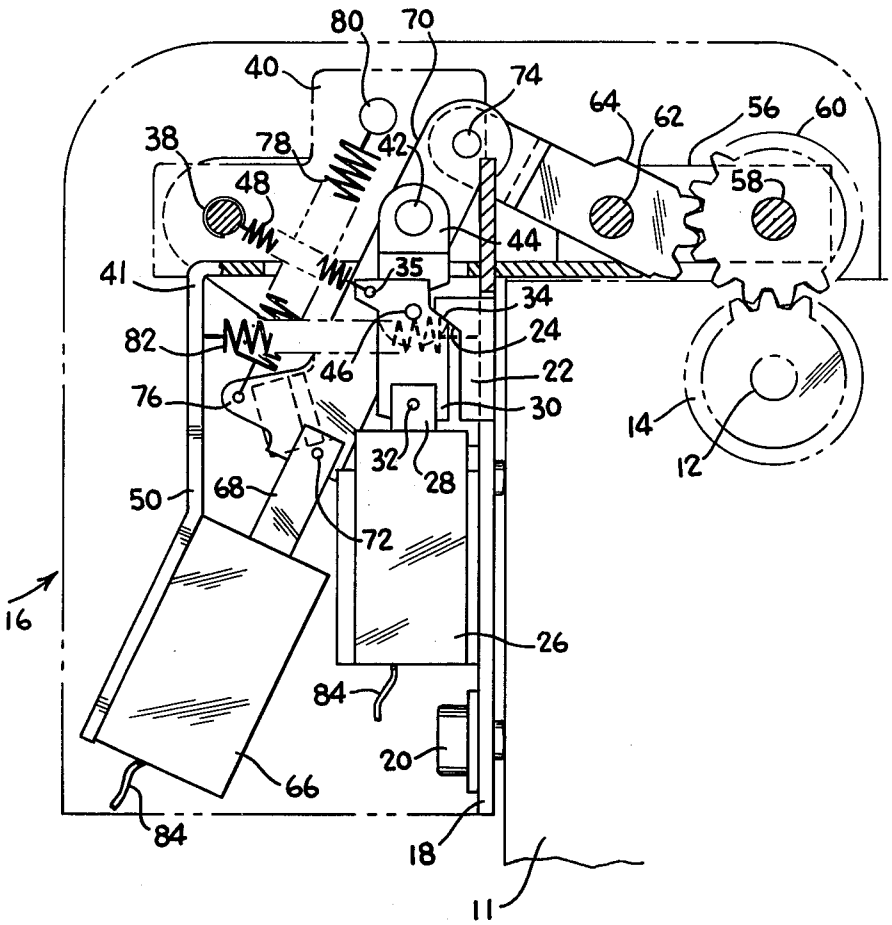
FIG. 2 shows a longitudinal cross-sectional view of the apparatus of FIG. 1 in a first mode of operation.
Figure 3:
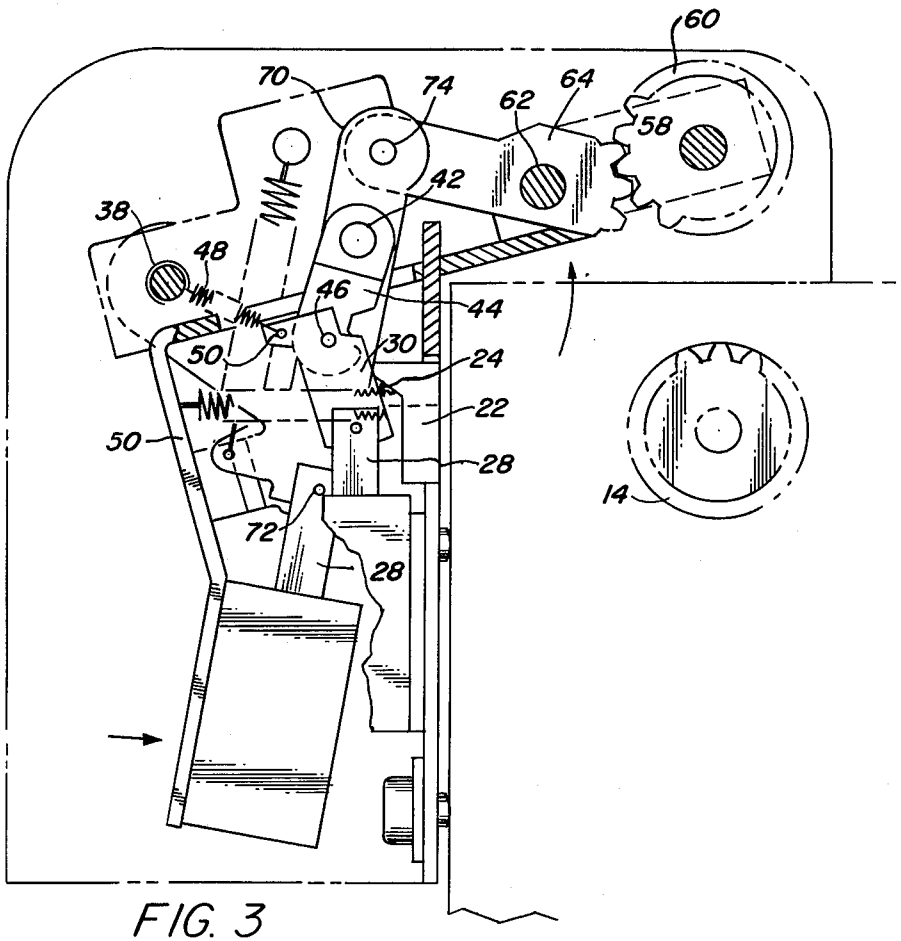
FIG. 3 is the same view of the apparatus as in FIG. 2 but in a second mode of operation.

A portion 50 of the frame member 41 extends downwardly as seen in FIGS. 2 and 3 and has an opening 52 therein that provides access to various components of the setting apparatus 16. The frame member 41 has another opening 54 therein. Located at the top of and integral with the frame member 41 are a pair of opposed support braces 56 that receive a shaft 58 therein. Mounted on the shaft 58 for rotation thereabout are a plurality of transfer wheels 60, the number of transfer wheels being equal to the number of drive gears 14. Pivot 62 is received within the support braces 56 and mounted thereon are a plurality of segment gears 64, there being an equal number of segment gears and transfer wheels 60. An equal number of solenoids 66 is mounted on the frame portion 50, each solenoid having a plunger 68 extending therefrom. A linkage member 70 is attached to each of the plungers 68 as by a pin 72 extending through both members. The upper end of each linkage member 70 is aligned with a respective segment gear 64 and attached thereto by another pin 74. Each linkage member 70 also has an eyelet member 76 which receives one end of an extension spring 78, the other end of each spring being supported upon a shaft 80 supported between the side plates 40. Another extension spring 82 extends from the frame member 41 to the base 18.

Figure 4:
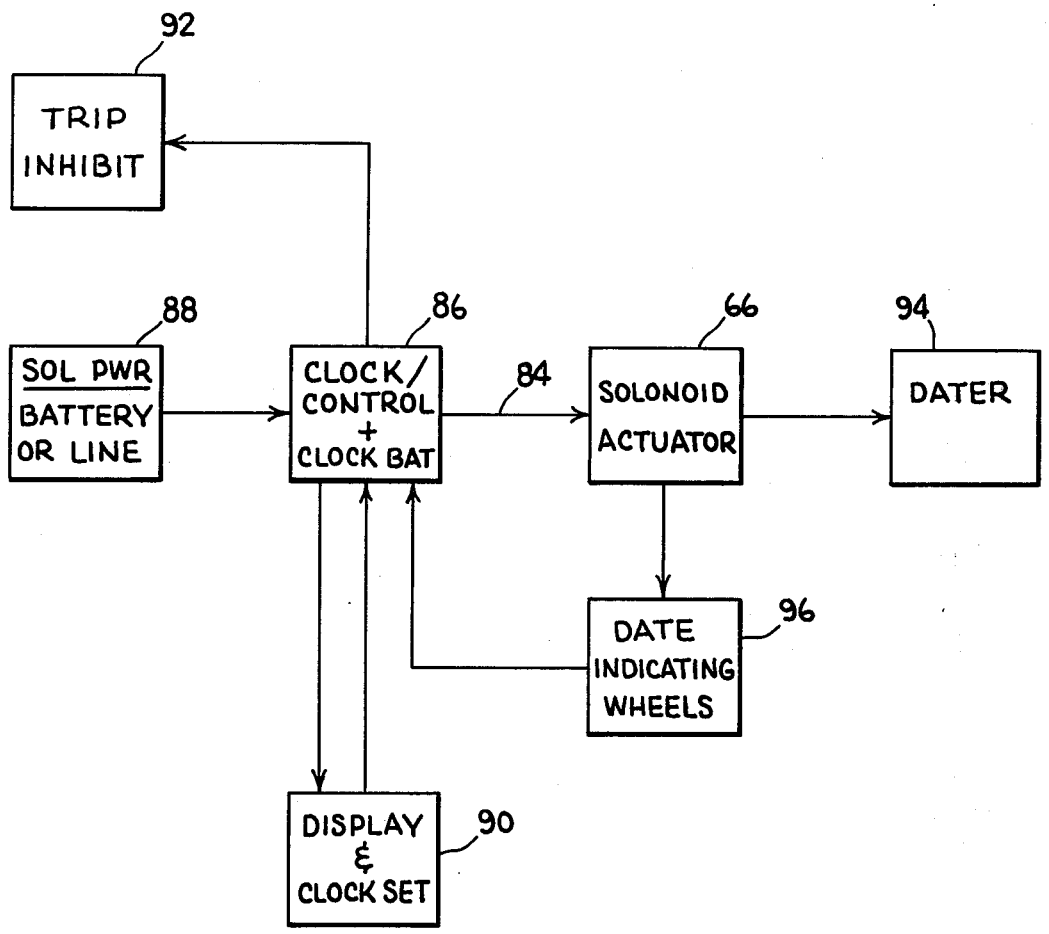
FIG. 4 is a block diagram of circuitry that may be used to operate the apparatus shown in FIGS. 1–3.

A lead 84 extends from each solenoid 26, 66 to a timing means 86. The timing means 86 may be of any convenient type which would periodically send a pulse to one or more selected solenoids. Timing means 86 of this type are well known in the art and will not be described in detail. An example of commercially available timing means is series MK 50250N digital clock marketed by Mostek Corp. of Carrollton, Texas. FIG. 4 shows a representation of the type of system that may be utilized in conjunction with the automatic date setter 16. Referring now to FIG. 4, the solenoids 26, 66 are shown collectively at 83 and the lead 84 is electrically connected to the timing means or clock control 86. The clock control 86 in turn is electrically connected to a power source 88, a display and clock set 90 and a trip inhibitor 92. The solenoids 83 mechanically engage as described above a dater 94 which would be part of the postage meter 10 and a date indicating wheel unit 96, the latter also being in electrical connection with the clock control. Alternatively, the leads 84 may be connected to a manually operated switch thereby allowing the solenoids 26, 66 to be enabled manually.

In operation, the automatic date setter 16 would be normally in the mode of operation as shown in FIG. 3, i.e., the transfer gear 60 would be disengaged from the drive gear 14 of the postage meter 10. At the time a date change is to be made, a signal is sent to the solenoid 26 and the plunger 28 is pulled downwardly to a position as shown in FIG. 2, to overcome the spring 48 and render the linkage 44 and connection link 30 parallel to one another. With the pulling down of the plunger 28, and the corresponding movement of linkage member 30 and linkage 44, the pivot 42 will be pulled downwardly thereby pulling the side plates 40 downwardly and rotating the same about the shaft 38 in a clockwise direction as seen in FIGS. 2 and 3 overcoming spring 82. With this movement, the transfer wheels 60 will be moved into engagement with the drive gears 14. The cam member 22, in combination with the connection link 30 acts as a helper lock to maintain the date setter 16 in the position as shown in FIG. 2. The interaction of the abutting surfaces 24, 34 lock the connection link 30 and linkage 44 in the extended position so that any separating force present from the interaction of the drive gears 14 and transfer wheels 60 will be resisted. It will be appreciated that such a helper lock may not be required and is shown only as an optional feature.

Subsequent to the engagement of the drive gears 14 and transfer wheels 60, one or more of the solenoids 66 will receive a signal whereby the plunger 68 of the enabled solenoid would be pulled downwardly. Upon this pulling down of the plunger 68 the spring 78 is overcome and the linkage member 70 pulled downwardly. With this downward pulling of the linkage member 70, the segment gear 64 is rotated about the shaft 62 and the transfer wheel 60 is in turn rotated. Upon rotation of the transfer wheel 60, the drive gear 14 will be rotated thereby actuating the gear train of the postage meter 10 to change the associated date wheel therein. As soon as the signal is sent to the solenoid 66 and upon completion of rotation of the drive gear 14, the solenoid 26 is disabled and the reverse takes place, i.e. the plunger 28 will be pushed upwardly, the surface of the linkage member 34 will slide on the cam member 24 to be pushed outwardly with the cooperation of the spring 48, until such time as the plunger 28 has been extended in full length. Upon the occurring, the other solenoid 66 will be disabled and will be returned to the position shown in FIGS. 2 and 3.

The invention thus far has been shown and described as comprising two units, the postage meter 10 and the postage meter automatic date setter 16 which is attached to the postage meter. It will be appreciated that these two units may be combined in a single unit, i.e., a postage meter having automatic date changing means of the type described herein. Additionally, the number of functions may be expanded to include time changes as well as date changes.

The correct pulse train for a given date change is determined by a pulse chart and incorporated into the logic of the timing means 86. For example, the simplest date change would be from one day to another, such as May 1 to May 2 and would be one pulse supplied to a solenoid 26 to engage the drive gear 14 and transfer gear 64 and one pulse to one of the solenoids 66-1 to pivot one segment gear 64 thereby rotating its associated gears 14, 64. The selection of solenoids, the reduction of voltage and the time delays would also be encompased in the circuitry. The least number of pulses being two, the greatest number would be for the date change from Feb. 28 to March 1. This change would have the units solenoid 66-1 pulse five times; 9, 0, -, -, 1; the tens solenoid 66-2 pulse two times; 3, - ; and the months solenoid 66-3 pulse once from February to March and the engaging solenoid 26 the required times.

The date setter 16 may be designed to be operated either on battery pack and be self-contained or to operate on a line voltage power pack and a five volt logic supply battery. The self-contained system would automatically set the date even though the meter 10 is detached from the mailing machine 15. An alternative would be to use a smaller battery to drive the logic and a 12V power supply to power the solenoids 26, 66. The smaller battery would drive the logic, keep the date, and be modular with the postage meter 10. The power pack could be modular with the mailing machine 15. When the postage meter 10 is separated from the mailing machine 15, the clock would continue to run keeping track of the date changes missed by storing the proper number of pulses for each solenoid to set the correct date when the postage meter 15 is returned to a "plugged in" mailing machine 15. If a power failure occurs, the same technique would be used to reset the electronic and the mechanical date. The amount of storage is optional since the number of bits per any given date change is minimal.

This concept will actuate solenoid 26 each time a pulse for a date setting function is originated and will not disengage until the date setting is fully completed. Conversely the date setting function shall not disengage until solenoid 26 is deactivated and the transfer wheels are clear of the drive gears 14. This type cycling ensures that the date changers are returned in an actuated mode so as not to disturb the date "setting" and also puts less of a heat load on the solenoid 26. The gear separating forces are counteracted by a mechanical "helper lock", which is only effective with an energized solenoid 26.

What is claimed is:

1. An apparatus for automatically setting the date of a postage meter, which meter has a gear that is part of a drive train for the postage meter print wheels and date indicator wheels, the combination comprising:

a housing:

first and second solenoid means received within said housing;

a frame member pivotably supported by said housing;

first linkage means supported within said housing and engaged by said first solenoid means;

gear means rotatably supported by said frame member and spaced relative to the drive train gear of the postage meter, said gear means being rotatably engaged by said linkage means;

means for periodically supplying an enabling pulse to said first solenoid means whereby said first linkage means is actuated to rotate said gear means;

second linkage means mechanically connected between said second solenoid means and said frame member to pivot said frame member upon the enabling of said second solenoid means; and means for periodically supplying an enabling pulse to said second solenoid means whereby said gear means is placed into and out of engagement with the drive train gear.

DESCRIPTION OF THE PREFERRED EMBODIMENT

The following examples illustrate the invention. They are set forth as a further description but are not to be construed as limiting the invention thereto.

EXAMPLE 1

A dry blend of poly(1,4-butylene terephthalate), intrinsic viscosity 0.8 dl/g., melt viscosity 1700 poise, a polycarbonate resin (LEXAN 121, General Electric Co., intrinsic viscosity 0.45 dl/g.), ⅛" glass fibers (Owens Corning OCF 419), Ferro 904 antioxidant and zinc stearate are compounded and extruded at 450°–570° F. in an extruder. The extrudate is pelletized and injection molded at 525° F. (mold temperature 150° F.). For comparison purposes a composition is prepared without zinc stearate. The formulations and physical properties obtained are shown in Table 1.

Table 1.

Physical Properties of Reinforced Compositions

| Ingredients (parts by weight) | 1 | 1A* |
|---|---|---|
| poly(1,4-butylene terephthalate) | 50 | 50 |
| polycarbonate resin | 20 | 20 |
| fibrous glass reinforcement ⅛ inch | 30 | 30 |
| antioxidant | 0.05 | 0.05 |
| zinc stearate | 0.2 | — |
| **Properties** | | |
| Heat Deflection Temp., ° F. 264 psi | 380 | 400 |
| Notched Izod impact, ft.lbs./in. | 1.7 | 1.7 |
| Unnotched Izod impact, ft.lbs./in. | 11.9 | 12.5 |
| Tensile strength, psi | 18,600 | 16,500 |
| Flexural modulus, psi | 1,109,000 | 1,095,000 |
| Flexural strength, psi | 29,000 | 30,600 |
| Warp on 4 inch Disc (mm.) | 0 | 0 |
| Warp after 30 min. at 350° F. (mm.) | 10 | 19 |

*control - typical properties

When the composition of this invention (Example 1) is injection molded into a four inch disc the warpage after heating is only 10 mm. In contrast thereto, an identical part molded from the control sample (1A*) has a significantly increased warpage of 19 mm., which is, however significantly better than the 25 mm. found with polycarbonate omitted (see later).

EXAMPLES 2–4

Dry blends of poly(1,4-butylene terephthalate), intrinsic viscosity 0.8 dl./g., optionally poly(ethylene terephthalate), intrinsic viscosity 0.62 dl./g., optionally a polycarbonate resin (LEXAN 121, General Electric Company, intrinsic viscosity, 0.45 dl./g.), ⅛ inch glass fibers (OCF 419), Ferro 904 antioxidant, mold release agent, optionally talc, and zinc stearate are compounded and extruded at 520° F. The extrudates are pelletized and injection molded at 525° F. (mold temperature 150° F.). For comparison purposes two compositions are prepared without zinc stearate, and without zinc stearate and either poly(ethylene terephthalate) or a polycarbonate resin. The formulations and the physical properties obtained are shown in Table 2.

Table 2.

Physical Properties of Reinforced Compositions

| Example / Ingredients (parts by weight) | 2 | 2A* | 3 | 4 | 4A* |
|---|---|---|---|---|---|
| poly(1,4-butylene terephthalate) | 50 | 70 | 50 | 45 | 45 |
| poly(ethylene terephthalate) | 20 | — | — | 20 | 20 |
| polycarbonate resin | — | — | 20 | 10 | 10 |
| fibrous glass reinforcement | 30 | 30 | 30 | 10 | 10 |
| talc | — | — | — | 15 | 15 |
| Ferro 904/mold release | 0.05/.1 | 0.05/.1 | 0.05/.1 | 0.05/.1 | 0.05/.1 |
| zinc stearate | 0.1 | — | .1 | .1 | — |
| **Properties** | | | | | |
| Heat deflection temperature, ° F. at 264 psi | 390 | 406 | 336 | 360 | 347 |
| Notched Izod impact, ft.lbs./in. | 1.9 | 2.0 | 2.0 | .88 | .88 |
| Unnotched Izod impact, ft.lbs./in. | 14 | 12 | 14 | 7.9 | 7.5 |
| Flexural strength, psi | 25,000 | 26,000 | 26,000 | 18,200 | 17,000 |
| Tensile strength, psi | 15,000 | 17,000 | 17,000 | 12,800 | 12,000 |
| Flexural modulus, psi | 965,000 | 955,000 | 1,074,000 | 1,011,000 | 838,000 |
| Warp as molded (mm. in 4 in.) | 0 | 15 | 0 | 0 | 0 |
| Warp after 30 min. at 350° F. | 19 | 25 | 18 | 8 | 12 |

*Control tests

Examples 2 and 3 show that zinc stearate permits replacement of poly(butylene terephthalate) with poly(ethylene terephthalate) with minimal (except for heat distortion temperature with 20 parts of polycarbonate) undersirable effect and improved warp resistance. Example 4 in comparison with Control 4A shows a striking improvement in warp resistance when the reinforcement comprises a combination of glass fibers and mineral filler (Emtal talc, minus 325 mesh).

Obviously, other modifications and variations of the present invention are possible in the light of the above teachings. It is therefore, to be understood that changes may be made in the particular embodiments described above which are within the full intended scope of the invention as defined in the appended claims.

We claim:

1. A thermoplastic molding composition which, after molding, has increased resistance to warpage in comparison with glass fiber reinforced poly(1,4-butylene terehthalate), the composition consisting essentially of, in intimate admixture:

(a) a poly(1,4-butylene terephthalate) resin;

(b) a second resin selected from:

(i) a poly(ethylene terephthalate);

(ii) a polycarbonate; or (iii) a mixture of (i) and (ii);

(c) a reinforcing agent comprising glass fibers alone or in admixture with a mineral filler in an amount at least sufficient to provide reinforcement; and (d) a small effective warp resistance improving amount of zinc stearate.

2. A composition as defined in claim 1 wherein component (a) comprises from 1 to 99 parts by weight and component (b) comprises from 99 to 1 parts by weight per 100 parts by weight of the total resinous components in the composition.

3. A composition as defined in claim 2 wherein the polycarbonate resin has an intrinsic viscosity of from about 0.3 to about 0.45 deciliters per gram when measured in a solution in methylene chloride at 20° C.

4. A composition as defined in claim 1 wherein the reinforcing agent component (c) is present in an amount of at least about 1 part by weight per 100 parts by weight of the combined components (a), (b), (c) and (d).

5. A composition as defined in claim 4 wherein the reinforcing agent (c) is present in an amount of from about 1 to about 60 parts by weight per 100 parts by weight of the combined components (a), (b) and (c).

6. A composition as defined in claim 1 wherein the zinc stearate is present in an amount comprising from about 0.05 up to about 5 parts by weight based on 100 parts by weight of resinous components (a) and (b).

7. A composition as defined in claim 6 wherein the zinc stearate comprises from about 0.1 to about 1.0 parts by weight based on 100 parts by weight of resinous components (a) and (b).

8. A composition as defined in claim 6 wherein the polycarbonate resin consists of from 100 to 400 of said repeating units.

9. A composition as defined in claim 1 wherein reinforcing agent component (c) comprises glass fibers and fine particle size ground mica.

10. A composition as defined in claim 9 wherein the mica has a particle size of less than 325 mesh.

11. A composition as defined in claim 1 wherein each resin component (a) and (b) (i) has an intrinsic viscosity of at least about 0.4 deciliter per gram when measured in a solution in 60:40 mixture of phenol and tetrachloroethane at 30° C.

12. A composition as defined in claim 1 wherein the polycarbonate resin has an intrinsic viscosity of at least about 0.3 deciliters per gram when measured in a solution in methylene chloride at 20° C.

13. A composition as defined in claim 1 wherein the polycarbonate resin (b) (ii) has repeating units of the formula

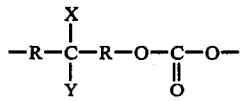

wherein each —R— is selected from the group consisting of phenylene, halo-substituted phenylene and alkyl substituted phenylene, and X and Y are each selected from the group consisting of hydrogen, hydrocarbon radicals free from aliphatic unsaturation and of radicals which together and with the adjoining

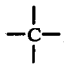

atom form a cycloalkane radical, the total number of carbon atoms in X and Y being up to 12.

14. A composition as defined in claim 13 wherein the polycarbonate resin (b) (ii) has repeating units of the formula

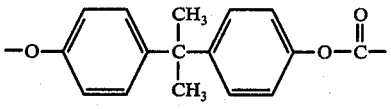

15. A composition as defined in claim 12 wherein the zinc stearate is present in an amount comprising from about 0.05 to up to about 5 parts by weight based on 100 parts by weight of components (a) and (b).

16. A composition as defined in claim 15 wherein the zinc stearate comprises from about 0.05 to about 1.0 parts by weight based on 100 parts by weight of components (a) and (b).

* * * * *